US010811774B2

(12) United States Patent
Hsiao et al.

(10) Patent No.: US 10,811,774 B2
(45) **Date of Patent: *Oct. 20, 2020**

(54) LOOP ANTENNA

(71) Applicant: ASUSTeK COMPUTER INC., Taipei (TW)

(72) Inventors: Ya-Wen Hsiao, Taipei (TW); Saou-Wen Su, Taipei (TW); Cheng-Tse Lee, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 34 days.

This patent is subject to a terminal disclaimer.

(21) Appl. No.: 16/226,718

(22) Filed: Dec. 20, 2018

(65) Prior Publication Data

US 2019/0214730 A1 Jul. 11, 2019

(30) Foreign Application Priority Data

Jan. 8, 2018 (TW) ..... 107100704 A

(51) Int. Cl.
*H01Q 1/22* (2006.01)
*H01Q 7/00* (2006.01)
*H01Q 21/24* (2006.01)

(52) U.S. Cl.
CPC ..... *H01Q 7/005* (2013.01); *H01Q 21/245* (2013.01); *H01Q 1/2266* (2013.01)

(58) Field of Classification Search
CPC ..... H01Q 5/321; H01Q 5/378; H01Q 9/42; H01Q 1/241–245; H01Q 1/2266; H01Q 7/005; H01Q 21/245; H01Q 21/005
See application file for complete search history.

(56) References Cited

U.S. PATENT DOCUMENTS

2008/0036666 A1* 2/2008 Shih ..... H01Q 1/243 343/702
2009/0179800 A1* 7/2009 Chiu ..... H01Q 1/2266 343/700 MS (Continued)

FOREIGN PATENT DOCUMENTS

TW I227576 B 2/2005
TW I293215 B 2/2008

(Continued)

OTHER PUBLICATIONS

Office Action issued in corresponding Taiwan patent application dated Dec. 20, 2018.

*Primary Examiner* — Awat M Salih
(74) *Attorney, Agent, or Firm* — McClure, Qualey & Rodack, LLP

(57) ABSTRACT

This disclosure provides a loop antenna, including a substrate, and a grounding portion, a matching portion, a first radiating portion, a second radiating portion, and a feed portion that are located on the substrate. The first radiating portion includes a first radiating segment and a second radiating segment. The grounding portion includes a first grounding segment and a second grounding segment. The second grounding segment is perpendicularly connected to a first end of the first grounding segment. The matching portion is connected to a second end of the first grounding segment and the first radiating segment. The first radiating segment extends from the matching portion away from the first grounding segment. The second radiating segment extends from the first radiating segment toward the second grounding segment. There is a coupling gap between the second radiating portion and the second radiating segment, and the second radiating portion extends toward the second grounding segment. The feed portion is located between an (Continued)

end of the second radiating portion and the second grounding segment to receive and send a feed signal.

10 Claims, 10 Drawing Sheets

(56) References Cited

U.S. PATENT DOCUMENTS

| | | | | |
|---|---|---|---|---|
| 2009/0273530 | A1 | 11/2009 | Chi et al. | |
| 2010/0328182 | A1 | 12/2010 | Wong et al. | |
| 2011/0095952 | A1* | 4/2011 | Lai | H01Q 9/42 343/749 |
| 2011/0102283 | A1 | 5/2011 | Chang et al. | |
| 2012/0007782 | A1 | 1/2012 | Nishio et al. | |
| 2013/0241777 | A1* | 9/2013 | Chang | H01Q 1/243 343/700 MS |

FOREIGN PATENT DOCUMENTS

| | | | |
|---|---|---|---|
| TW | 201440319 | A | 10/2014 |
| TW | 200507345 | A | 2/2015 |

* cited by examiner

LOOP ANTENNA

CROSS-REFERENCE TO RELATED APPLICATION

This application claims the priority benefit of TW application serial No. 107100704, filed on Jan. 8, 2018. The entirety of the above-mentioned patent application is hereby incorporated by reference herein and made a part of the specification.

BACKGROUND OF THE INVENTION

Field of the Invention

This disclosure relates to an antenna component, and in particular, to a loop antenna.

Related Art

A built-in antenna, for example, a dipole antenna, a planar inverted-F antenna (PIFA), or a loop antenna, is mostly applied to a mobile apparatus such as a notebook computer, a tablet computer, or a mobile phone. A particular antenna space needs to be reserved in the internal space of the apparatus.

However, there are feature requirements that a mobile apparatus is light, thin, and convenient to carry. Besides, a metal or a material having an electricity conduction capability is often used in appearance design of a product, so that the product has aesthetic appeal and desirable texture in industrial design. Consequently, a radiating feature of an antenna obviously degrades because a space or a clearance area is insufficient. However, a sufficient clearance area increases the thickness of an apparatus. Therefore, antenna design is confronted with harsh environments because of the requirements.

BRIEF SUMMARY OF THE INVENTION

According to one aspect of the disclosure, a loop antenna is provided. The loop antenna includes a substrate, a grounding portion, a matching portion, a first radiating portion, a second radiating portion, and a feed portion. The grounding portion is located on the substrate, and the grounding portion includes a first grounding segment and a second grounding segment. The second grounding segment is perpendicular to the first grounding segment and is connected to a first end of the first grounding segment. The matching portion is located on the substrate and is connected to a second end of the first grounding segment. The first radiating portion is located on the substrate, and the first radiating portion includes a first radiating segment and a second radiating segment. The first radiating segment is connected to the matching portion and extending from the matching portion toward a direction which away from the first grounding segment. The second radiating segment is connected to the first radiating segment and extends from the first radiating segment toward the second grounding segment. The second radiating portion is located on the substrate, there is a coupling gap between a first end of the second radiating portion and an end of the second radiating segment, and the second radiating portion extends toward the second grounding segment. The feed portion is located on the substrate and located between an end of the second radiating portion adjacent to the second grounding segment and the second grounding segment, and the feed portion is configured to receive or transmit a signal from a signal source.

DETAILED DESCRIPTION OF THE EMBODIMENTS

Figure 1:
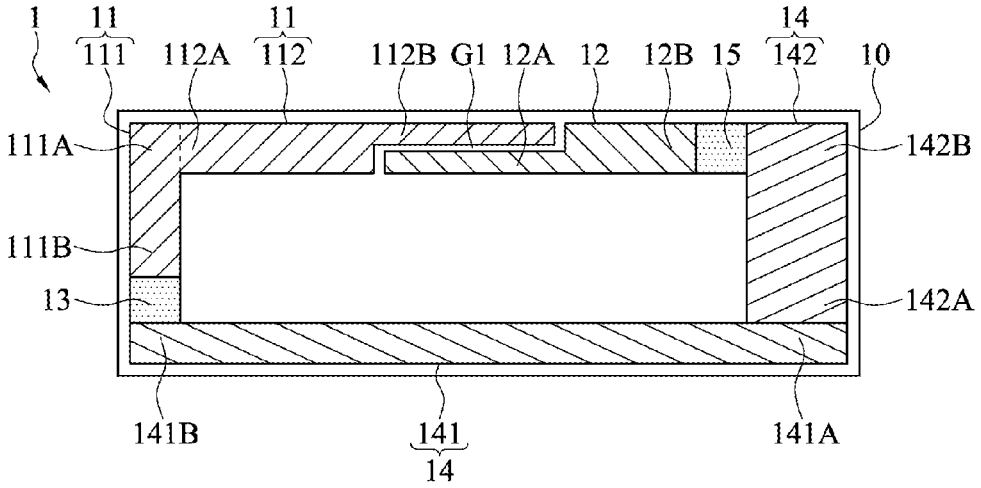
FIG. 1 is a schematic diagram of an embodiment of a loop antenna according to this disclosure.

FIG. 1 is a schematic diagram of an embodiment of a loop antenna 1 according to this disclosure. Referring to FIG. 1, the loop antenna 1 includes a substrate 10, and a first radiating portion 11, a second radiating portion 12, a matching portion 13, and a grounding portion 14 that are located on the substrate 10. The first radiating portion 11, the second radiating portion 12, and the grounding portion 14 is made of conductive materials (in an embodiment, copper, silver, metal, aluminum, or alloy thereof), and the first radiating portion 11, the second radiating portion 12, and the grounding portion 14 is printed on the substrate 10.

The grounding portion 14 is configured to provide signal grounding, and the grounding portion 14 is connected to a system grounding surface of an electronic apparatus including the loop antenna 1. The grounding portion 14 includes a first grounding segment 141 and a second grounding segment 142. A first end 142A of the second grounding segment 142 is connected to a first end 141A of the first grounding segment 141, and the first grounding segment 141 is perpendicular to the second grounding segment 142 (in an embodiment, a length direction of the first grounding segment 141 is perpendicular to a length direction of the second grounding segment 142). The first grounding segment 141 and the second grounding segment 142 form an inverted-L shape.

The first radiating portion 11 includes a first radiating segment 111 and a second radiating segment 112. A first end 111A of the first radiating segment 111 is connected to a first end 112A of the second radiating segment 112. The matching portion 13 is located between a second end 111B of the first radiating segment 111 and a second end 141B of the first grounding segment 141, and the matching portion 13 is connected to the second end 111B of the first radiating segment 111 and the second end 141B of the first grounding segment 141. The first radiating segment 111 extends from the matching portion 13 away from the first grounding segment 141, and the second radiating segment 112 extends from the first radiating segment 111 toward the second grounding segment 142 of the grounding portion 14.

The second radiating portion 12 extends toward the second grounding segment 142 along a length direction of the second radiating segment 112 of the first radiating portion 11, and there is a first coupling gap G1 between a first end 12A of the second radiating portion 12 and a second end 112B of the second radiating segment 112. The feed portion 15 is located between a second end 12B of the second radiating portion 12 (adjacent to a second end 142B of the second grounding segment 142) and the second end 142B of the second grounding segment 142 of the grounding portion 14. The feed portion 15 receives or transmits a signal from a signal source, to excite the first radiating portion 11, the second radiating portion 12, the grounding portion 14, and the matching portion 13 to form a closed current path. Herein, when a signal is fed from the feed portion 15, the first coupling gap G1 between the first radiating portion 11 and the second radiating portion 12 further excites a resonant mode having a 0.25-wavelength of the loop antenna 1, so that the loop antenna 1 operates in a lower frequency band (a 0.25-wavelength) and a higher frequency band (a 0.5-wavelength). Besides, the matching portion 13 between the first radiating portion 11 and the grounding portion 14 adjusts an operating frequency in a higher frequency band and a lower frequency band in which the loop antenna 1 operates and impedance matching thereof, to reach an intended operating frequency band. This satisfies a current requirement for a narrow-bezel electronic apparatus.

Figure 2:
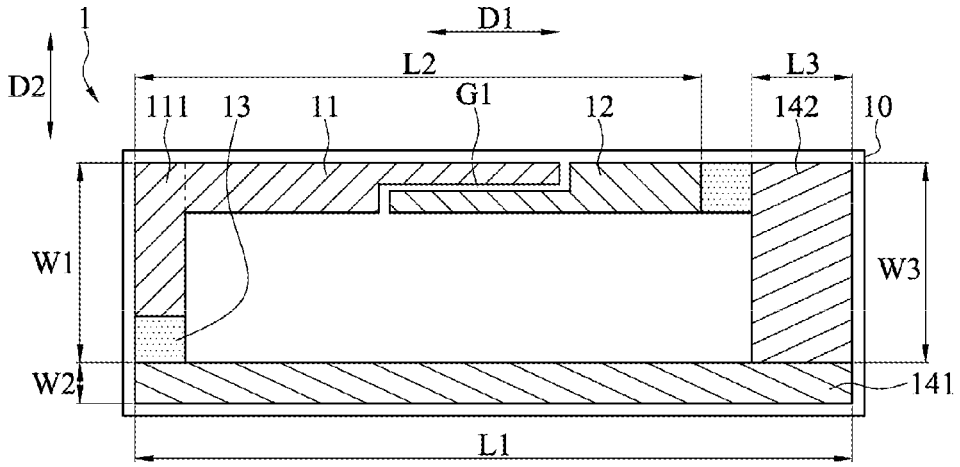
FIG. 2 is a schematic diagram of the size of the loop antenna in FIG. 1.

In an embodiment, as shown in FIG. 2, the loop antenna 1 has a length direction D1 and a width direction D2. The entire length L2 of the first radiating portion 11, the first coupling gap G1, and the second radiating portion 12 in the length direction D1 is 15 mm, the length L3 of the second grounding segment 142 in the length direction D1 is 4 mm, the length L1 of the first grounding segment 141 in the length direction D1 is 20 mm, the entire line width W1 of the first radiating segment 111 and the matching portion 13 in the width direction D2 is 4 mm, a line width W2 of the first grounding segment 141 in the width direction D2 is 1 mm, and a line width W3 of the second grounding segment 142 in the width direction D2 is 4 mm. Based on this, the entire size of the loop antenna 1 is 20 mm×5 mm, that is, 100 $mm^2$. Therefore, the loop antenna 1 satisfies a current requirement for a narrow-bezel (in an embodiment, a narrow bezel of 6 mm) electronic apparatus.

Figure 3:
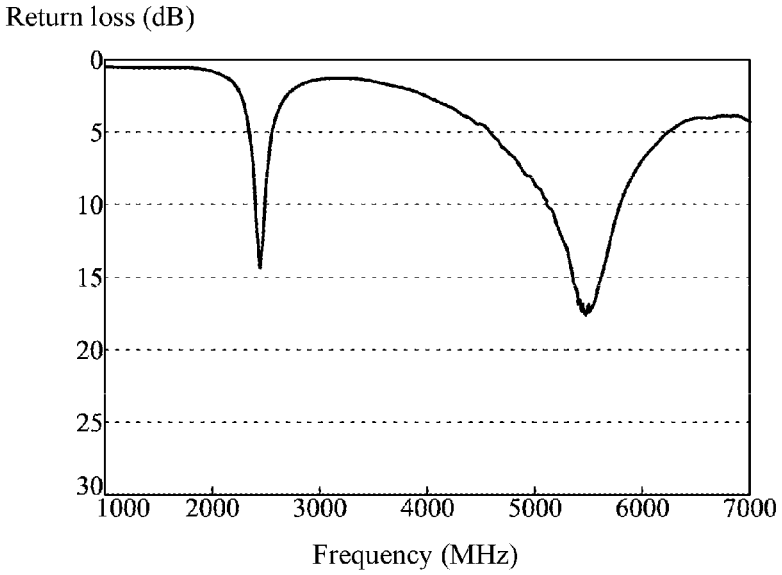
FIG. 3 is a diagram of return losses at various operating frequencies of an embodiment of a loop antenna according to this disclosure.
Figure 4A:
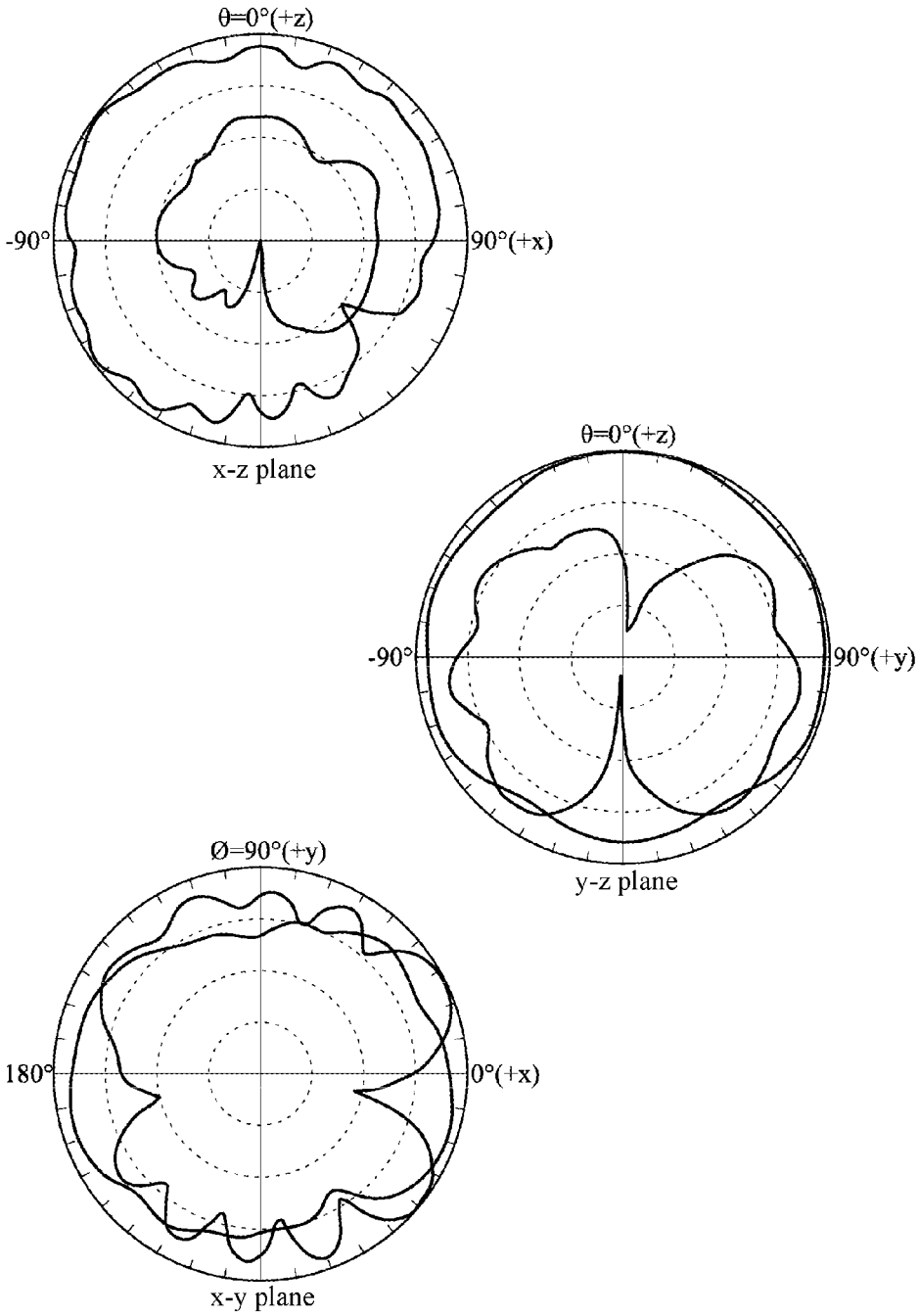
FIG. 4A is a radiating pattern at a frequency of 2.4 GHz of an embodiment of a loop antenna according to this disclosure.
Figure 4B:
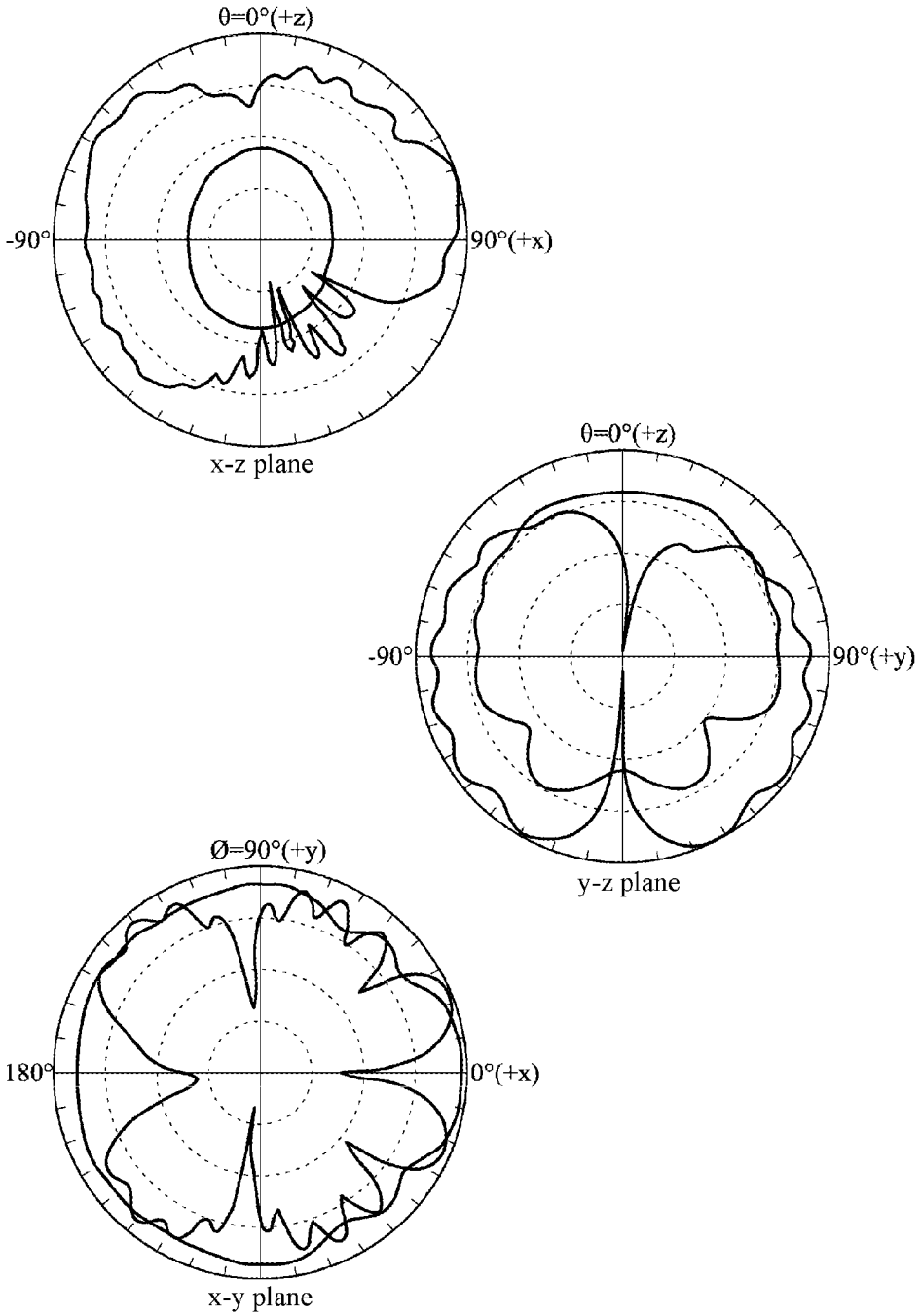
FIG. 4B is a radiating pattern at a frequency of 5.2 GHz of an embodiment of a loop antenna according to this disclosure.
Figure 4C:
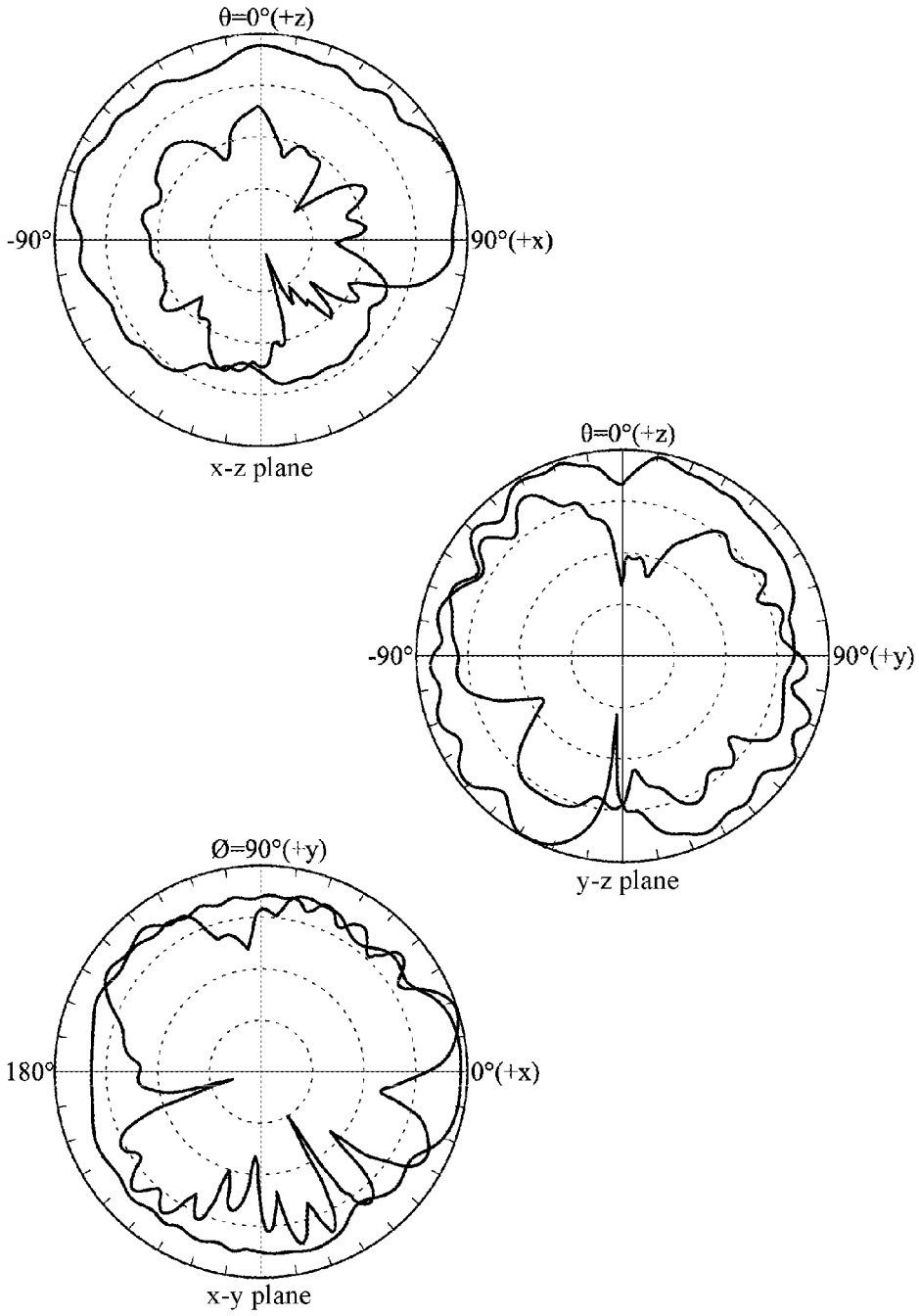
FIG. 4C is a radiating pattern at a frequency of 5.8 GHz of an embodiment of a loop antenna according to this disclosure.

Based on the size and the structure of the loop antenna 1, a lower frequency band in which the loop antenna 1 operates includes the 2.4 GHz band, and a higher frequency band in which the loop antenna 1 operates includes the 5.2 GHz and 5.8 GHz bands. Referring to FIG. 3, FIG. 3 is a diagram of return losses at various operating frequencies of an embodiment of a loop antenna 1 according to this disclosure. As shown in FIG. 3, a lower frequency band in which the loop antenna 1 is capable of operating the 2.4 GHz band, and a higher frequency band in which the loop antenna 1 is capable of operating the 5.2 GHz and 5.8 GHz bands. Further, referring to FIG. 4A to FIG. 4C, FIG. 4A to FIG. 4C are each a radiating pattern in each frequency band of 2.4 GHz, 5.2 GHz, and 5.8 GHz by the loop antenna 1. The pattern distributions shown in FIG. 4A to FIG. 4C indicate that the loop antenna 1 has desirable radiating gains in each direction.

In an embodiment, as shown in FIG. 1, the first radiating segment 111 is perpendicular to the second radiating segment 112 (that is, a length direction of the first radiating segment 111 is perpendicular to a length direction of the second radiating segment 112). That is, the first radiating segment 111 and the second radiating segment 112 also form an inverted-L shape which further forms the closed current path by combining with the first grounding segment 141 and the second grounding segment 142, the feed portion 15, and the matching portion 13. Besides, the first radiating segment 111 is parallel with the second grounding segment 142 and perpendicular to the first grounding segment 141.

Figure 5:
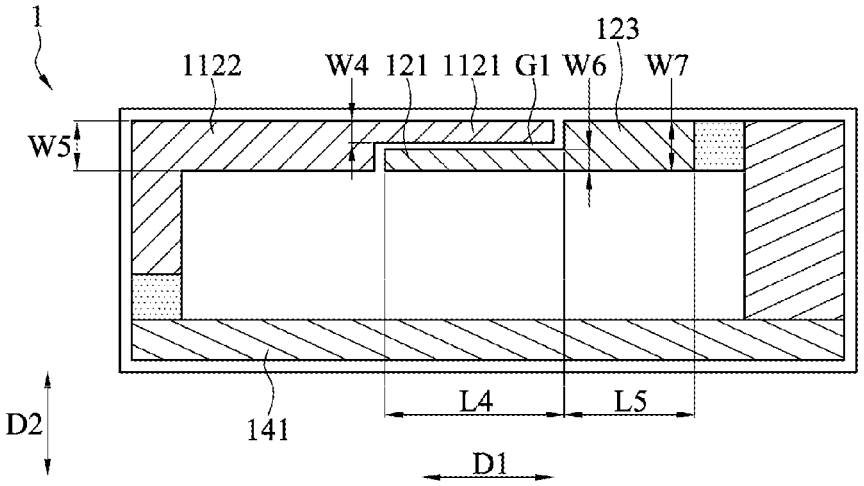
FIG. 5 is a schematic diagram of an embodiment of a loop antenna according to this disclosure.
Figure 6:
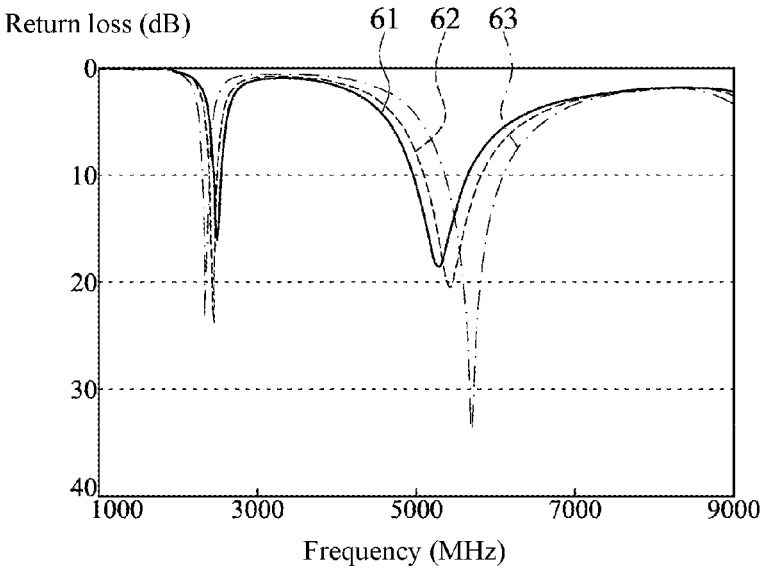
FIG. 6 is a diagram of return losses of a loop antenna corresponding to a second radiating portion having different lengths.
Figure 7:
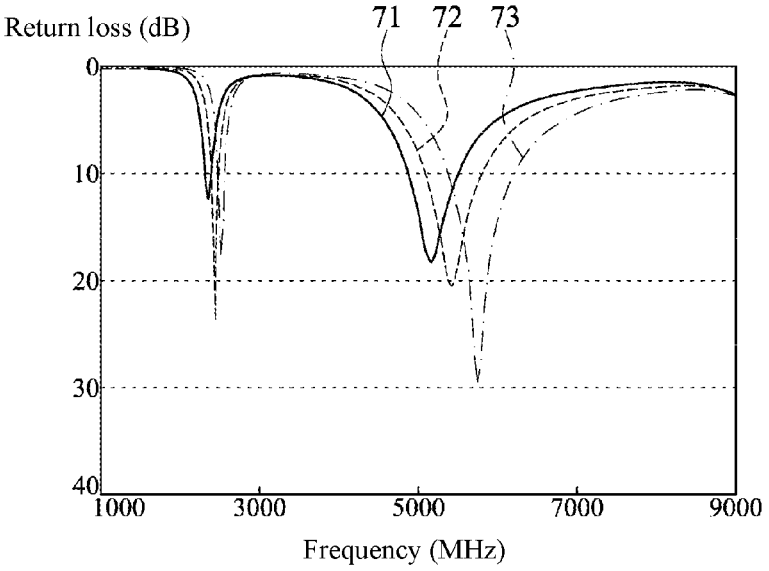
FIG. 7 is a diagram of return losses of a loop antenna corresponding to a second radiating portion having different lengths.

In an embodiment, referring to both FIG. 1 and FIG. 5, the second radiating segment 112 of the first radiating portion 11 includes a segment 1122 and a first protruding segment 1121. The first protruding segment 1121 is located at the second end 112B of the second radiating segment 112, and a line width W4 of the first protruding segment 1121 in the width direction D2 is less than a line width W5 of the segment 1122 in the width direction D2. Besides, the second radiating portion 12 includes a segment 123 and a second protruding segment 121. The second protruding segment 121 is located at the first end 12A of the second radiating portion 12, and a line width W6 of the second protruding segment 121 in the width direction D2 is less than a line width W7 of the segment 123 in the width direction D2. The first protruding segment 1121 is parallel with the second protruding segment 121. A vertical projection of the first protruding segment 1121 on the first grounding segment 141 partially overlaps a vertical projection of the second protruding segment 121 on the first grounding segment 141. A gap between the first protruding segment 1121 and the second protruding segment 121, a gap between the second protruding segment 121 and the segment 1122, and a gap between the first protruding segment 1121 and the segment 123 form the first coupling gap G1. Based on this, based on different lengths of the second radiating portion 12 in the length direction D1 (the lengths of the second radiating portion 12 include a length L4 of the second protruding segment 121 in the length direction D1 and a length L5 of the segment 123 in the length direction D1), the first coupling gap G1 having different sizes is formed between the second radiating portion 12 and the second radiating segment 112 of the first radiating portion 11, so that the loop antenna 1 generates a resonant mode with a 0.25-wavelength at 2.4 GHz. In an embodiment, the length L4 of the second protruding segment 121 in the length direction D1 falls within the range from 2.9 mm to 4.9 mm, and the length L5 of the segment 123 in the length direction D1 falls within the range from 1 mm to 3 mm. Referring to both FIG. 6 and FIG. 7, FIG. 6 and FIG. 7 are each a diagram of return losses of the loop antenna 1 corresponding to the second radiating portion 12 having different lengths. Return loss curves 61, 62, 63 respectively correspond to the length L5 of the segment 123 of 3 mm, 2 mm, and 1 mm in the length direction D1, and return loss curves 71, 72, 73 respectively correspond to the length L4 of the second protruding segment 121 of 4.9 mm, 3.9 mm, and 2.9 mm in the length direction D1. As shown in FIG. 7, when the length L4 is smaller, a center frequency of a lower frequency band and a higher frequency band included by the loop antenna 1 is higher. As shown in FIG. 6, when the length L5 is smaller, a center frequency of a lower frequency band included by the loop antenna 1 is lower, and a center frequency of a higher frequency band included by the loop antenna 1 is higher. Based on this, a designer of the loop antenna 1 further adjusts the length L4 of the second protruding segment 121 in the length direction D1 and the length L5 of the segment 123 in the length direction D1, to adjust a resonant mode of the loop antenna 1 in a lower frequency band and a higher frequency band.

Figure 8:
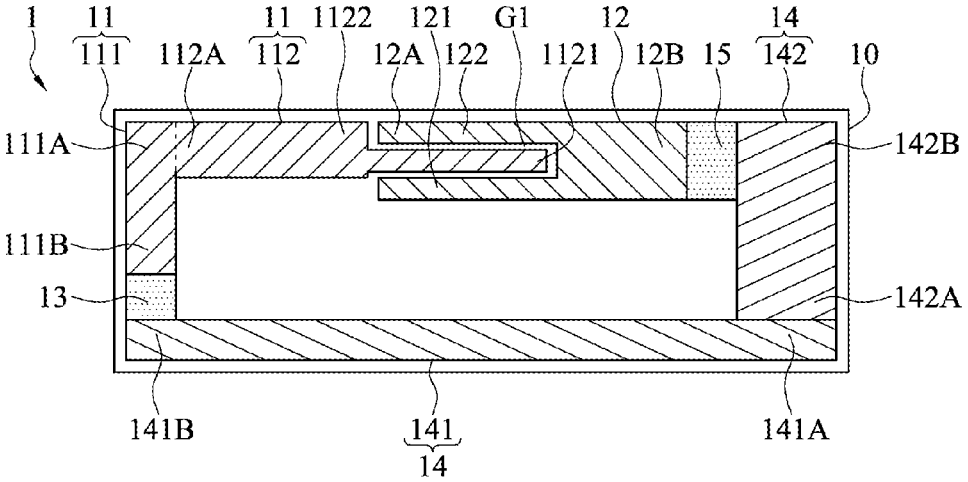
FIG. 8 is a schematic diagram of another embodiment of a second radiating portion of a loop antenna according to this disclosure.

FIG. 8 is a schematic diagram of another embodiment of a loop antenna 1 according to this disclosure. As shown in FIG. 8, the second radiating portion 12 further includes a third protruding segment 122. The third protruding segment 122 is also located at the first end 12A of the second radiating portion 12. The second protruding segment 121 is located on one side of the first protruding segment 1121 adjacent to the first grounding segment 141, and the third protruding segment 122 is located on the other side of the first protruding segment 1121 away from the first grounding segment 141. That is, the third protruding segment 122 and the second protruding segment 121 are respectively located on the two sides of the first protruding segment 1121. Further, a vertical projection portion of the third protruding segment 122 on the first grounding segment 141 overlaps vertical projections of the first protruding segment 1121 and the second protruding segment 121 on the first grounding segment 141. That is, the first coupling gap G1 is further located between the third protruding segment 122 and the first protruding segment 1121, and is located between the third protruding segment 122 and the segment 1122. Herein, the length of the third protruding segment 122 and the length of the second protruding segment 121 in the length direction D1 also affect a resonant mode of the loop antenna 1 in a lower frequency band and a higher frequency band.

Figure 9:
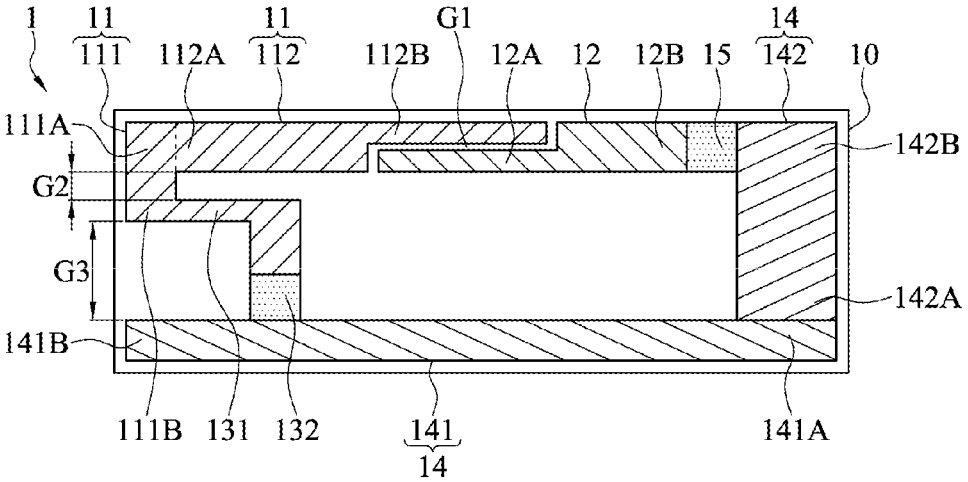
FIG. 9 is a schematic diagram of an embodiment of a matching portion of a loop antenna according to this disclosure.

In an embodiment, the matching portion 13 is implemented by using a passive component, and in an embodiment, the passive component is a chip inductor, a chip capacitor, or any combination thereof. The matching portion 13 implemented by using a passive component is connected to the second end 111B of the first radiating segment 111 and the first grounding segment 141 by welding. In an embodiment, the matching portion 13 is a chip inductor, and an inductance of the matching portion 13 is 4.7 nH. In some other embodiments, the matching portion 13 is also be implemented by using a distributed inductor and/or capacitor, that is, the matching portion 13 is implemented by printing circuit techniques on the substrate 10. Referring to FIG. 9, FIG. 9 is a schematic diagram of an embodiment of the matching portion 13 of the loop antenna 1 according to this disclosure. The matching portion 13 includes a first matching segment 131 and a second matching segment 132. The first matching segment 131 is connected to the second end 111B of the first radiating segment 111. The first matching segment 131 extends from the second end 111B of the first radiating segment 111 toward the second grounding segment 142. There is a second coupling gap G2 between the first matching segment 131 and the second radiating segment 112, and there is a third coupling gap G3 between the first matching segment 131 and the first grounding segment 141. The second coupling gap G2 and the third coupling gap G3 are 1 mm, but are not limited thereto. The second matching segment 132 is connected to the first matching segment 131, where the second matching segment 132 extends toward the first grounding segment 141 from the first matching segment 131 to connect to the first grounding segment 141.

Figure 10:
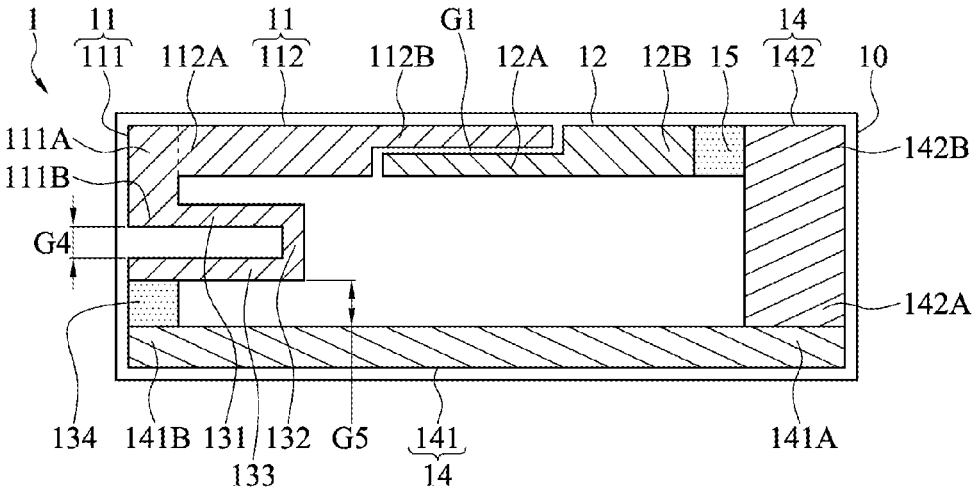
FIG. 10 is a schematic diagram of another embodiment of a matching portion of a loop antenna according to this disclosure.

Further, referring to FIG. 10, FIG. 10 is a schematic diagram of another embodiment of the matching portion 13 of the loop antenna 1 according to this disclosure. The matching portion 13 further includes a third matching segment 133 and a fourth matching segment 134 in addition to the first matching segment 131 and the second matching segment 132. The third matching segment 133 is connected to the second matching segment 132, where the third matching segment 133 extends from the second matching segment 132 away from the second grounding segment 142, there is a fourth coupling gap G4 between the third matching segment 133 and the first matching segment 131, and there is a fifth coupling gap G5 between the third matching segment 133 and the first grounding segment 141. The fourth coupling gap G4 and the fifth coupling gap G5 are 0.5 mm, but are not limited thereto. The fourth matching segment 134 is connected to the third matching segment 133, where the fourth matching segment 134 extends toward the first grounding segment 141 from the third matching segment 133 to connect to the first grounding segment 141.

Based on this, by using the coupling gaps G2, G3, G4, and G5, the matching portion 13 implemented by printing circuit techniques also effectively adjusts a center frequency in a resonant mode at 2.4 GHz and a resonant mode between 5.2 GHz and 5.8 GHz, and the matching portion 13 also adjusts impedance matching between a higher frequency band and a lower frequency band in which the loop antenna 1 operates.

Figure 11:
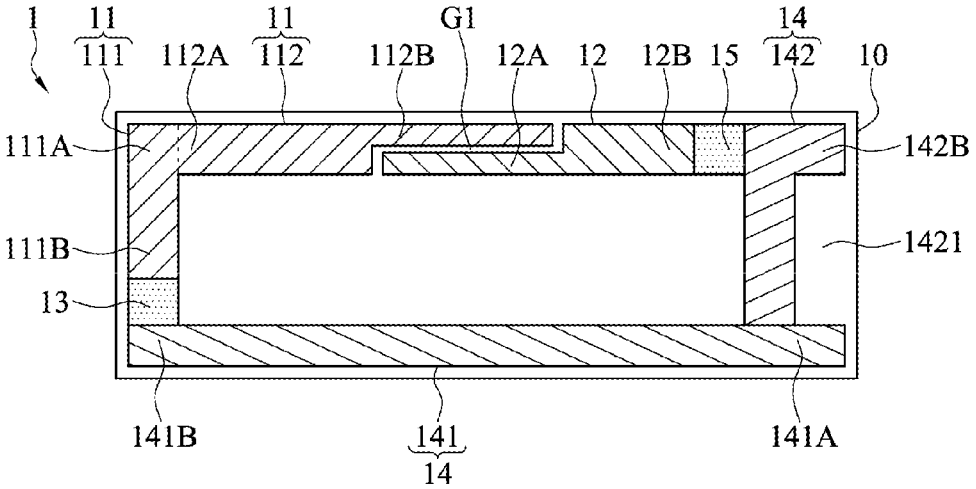
FIG. 11 is a schematic diagram of an embodiment of a second grounding segment of a loop antenna according to this disclosure.
Figure 12:
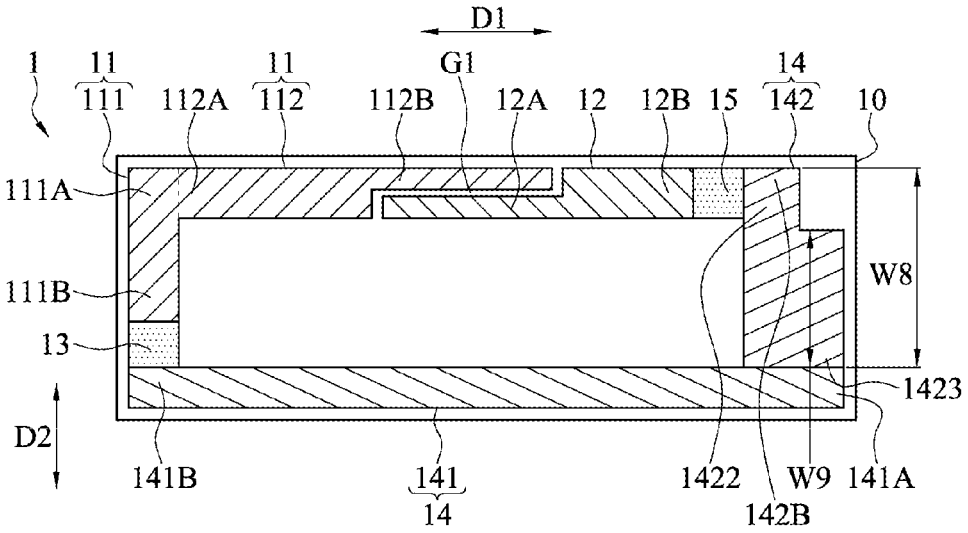
FIG. 12 is a schematic diagram of another embodiment of a second grounding segment of a loop antenna according to this disclosure.

In an embodiment, the second grounding segment 142 includes a notch. Referring to FIG. 11, FIG. 11 is a schematic diagram of an embodiment of the second grounding segment 142 of the loop antenna 1 according to this disclosure. The second grounding segment 142 includes a notch 1421. The second grounding segment 142 includes an inverted-L shape, which forms a U shape by combining a part of the first grounding segment 141, to optimize impedance matching of a higher frequency band of 5 GHz. In another embodiment, the second grounding segment 142 including the notch includes an L shape. Referring to FIG. 12, FIG. 12 is a schematic diagram of another embodiment of the second grounding segment 142. The second grounding segment 142 includes a first segment 1422 and a second segment 1423. A line width W8 of the first segment 1422 in the width direction D2 is greater than a line width W9 of the second segment 1423 in the width direction D2. The segments 1422 and 1423 having different line widths are also used to optimize impedance matching of a higher frequency band of 5 GHz.

Figure 13:
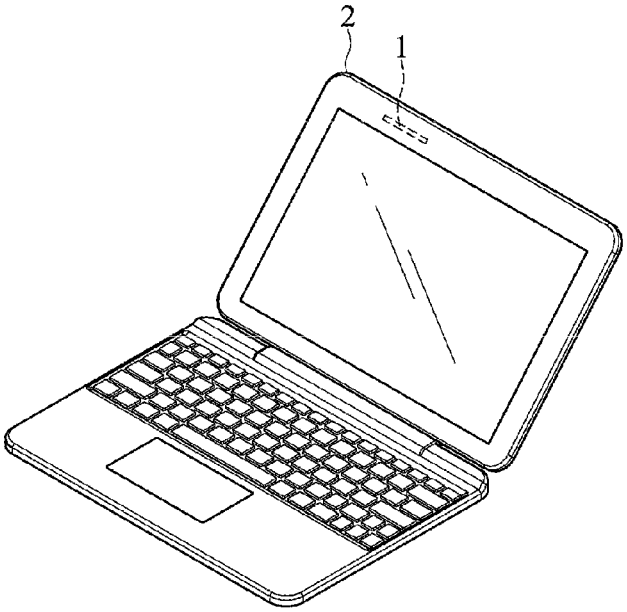
FIG. 13 is a schematic diagram of an embodiment of a loop antenna applied to an electronic apparatus according to this disclosure.

FIG. 13 is a schematic diagram of an embodiment of the loop antenna 1 applied to an electronic apparatus 2 according to this disclosure. Herein, in an embodiment, the electronic apparatus 2 shown in FIG. 13 is a notebook computer. However, this disclosure is not limited thereto. The electronic apparatus 2 is also a tablet computer or an All in One (AiO) computer. As described above, the size of the loop antenna 1 is 20 mm×5 mm, and the loop antenna 1 is disposed on a narrow bezel around the screen of the electronic apparatus 2, to satisfy a current requirement for a narrow-bezel electronic apparatus.

In conclusion, in an embodiment of the loop antenna according to this disclosure, a coupling gap between two radiating portions is used to excite a resonant mode having a 0.25-wavelength of the loop antenna, so that the loop antenna operates in at least two frequency bands of a lower frequency band and a higher frequency band. Besides, the matching portion adjusts impedance matching between a higher frequency band and a lower frequency band in which the loop antenna operates. Besides, the matching portion has an effect of increasing a radiating path of the loop antenna. Due to increasing the radiating path by matching portion, the loop antenna size can be reduced. The loop antenna having a small size is used to achieve an intended operating frequency band and antenna miniaturization without increasing a radiating path of a radiating portion, to satisfy a current requirement for a narrow-bezel electronic apparatus.

Although disclosed above, the embodiments of this disclosure are not intended to limit this disclosure, and any person with ordinary skills in the art may make some modifications and embellishments without departing from the spirit and scope of this disclosure. Therefore, the protection scope of this disclosure is subject to the appended claims.

What is claimed is:

1. A loop antenna, comprising:

a substrate;

a grounding portion, located on the substrate, the grounding portion comprising:

a first grounding segment; and a second grounding segment, perpendicular to the first grounding segment and connected to a first end of the first grounding segment;

a matching portion, located on the substrate and connected to a second end of the first grounding segment;

a first radiating portion, located on the substrate, the first radiating portion comprising:

a first radiating segment, connected to the matching portion and extending from the matching portion toward a direction which away from the first grounding segment; and a second radiating segment, connected to the first radiating segment and extending from the first radiating segment toward the second grounding segment;

a second radiating portion, located on the substrate, wherein there is a first coupling gap between a first end of the second radiating portion and an end of the second radiating segment, and the second radiating portion extends toward the second grounding segment; and a feed portion, located on the substrate and located between an end of the second radiating portion adjacent to the second grounding segment and the second grounding segment, the feed portion contacting the second grounding segment and the second radiating portion wherein the feed portion is configured to receive or transmit a signal from a signal source;

wherein the matching portion contacts the first grounding segment and the first radiating segment.

2. The loop antenna according to claim 1, wherein the second radiating segment comprises a first protruding segment, the second radiating portion comprises a second protruding segment, the second protruding segment is located at the first end of the second radiating portion, a vertical projection portion of the first protruding segment on the first grounding segment overlaps a vertical projection of the second protruding segment on the first grounding segment, and the first coupling gap is located between the first protruding segment and the second protruding segment.

3. The loop antenna according to claim 2, wherein the second radiating portion further comprises a third protruding segment located at the first end of the second radiating portion, the third protruding segment is located on one side of the first protruding segment away from the first grounding segment, the second protruding segment is located on the other side of the first protruding segment adjacent to the first grounding segment, a vertical projection of the third protruding segment on the first grounding segment partially is overlapping with the vertical projections of the first protruding segment and the second protruding segment on the first grounding segment, and the first coupling gap is located between the first protruding segment and the third protruding segment.

4. The loop antenna according to claim 1, wherein the matching portion comprises:

a first matching segment, connected to an end of the first radiating segment, the first matching segment is extending from the end of the first radiating segment toward the second grounding segment, there is a second coupling gap between the first matching segment and the second radiating segment, and there is a third coupling gap between the first matching segment and the first grounding segment; and a second matching segment, connected to the first matching segment, the second matching segment is extending toward the first grounding segment from the first matching segment to connect to the first grounding segment.

5. The loop antenna according to claim 1, wherein the matching portion comprises:

a first matching segment, connected to an end of the first radiating segment, the first matching segment is extending from the end of the first radiating segment toward the second grounding segment, and there is a second coupling gap between the first matching segment and the second radiating segment;

a second matching segment, connected to the first matching segment, the second matching segment is extending toward the first grounding segment from the first matching segment;

a third matching segment, connected to the second matching segment, the third matching segment is extending from the second matching segment toward a direction which away from the second grounding segment, there is a fourth coupling gap between the third matching segment and the first matching segment, and there is a fifth coupling gap between the third matching segment and the first grounding segment; and a fourth matching segment, connected to the third matching segment, the fourth matching segment is extending toward the first grounding segment from the third matching segment to connect to the first grounding segment.

6. The loop antenna according to claim 1, wherein the matching portion is implemented by at least one of a chip inductor or a chip capacitor.

7. The loop antenna according to claim 1, wherein the second grounding segment comprises a notch.

8. The loop antenna according to claim 1, wherein the loop antenna comprises a length direction and a width direction, and the second grounding segment comprises a first segment and a second segment that have different line widths in the width direction.

9. The loop antenna according to claim 1, wherein the loop antenna comprises a length direction and a width direction, and a sum of a line width of the first grounding segment in the width direction, a line width of the matching portion in the width direction, and a line width of the first radiating segment in the width direction is 5 mm.

10. The loop antenna according to claim 9, wherein the first coupling gap falls within the range from 0.2 mm to 1.1 mm.

* * * * *